US006176363B1

(12) United States Patent
Suverein et al.

(10) Patent No.: US 6,176,363 B1
(45) Date of Patent: Jan. 23, 2001

(54) COIN ELEVATING DEVICE

(75) Inventors: Cornelis M. Suverein, Rotterdam (NL); Leonardus A. P. Suverein, Essen (BE)

(73) Assignee: Suzo International (NL) B.V., Lt Oud-Beijerland (NL)

( * ) Notice: Under 35 U.S.C. 154(b), the term of this patent shall be extended for 0 days.

(21) Appl. No.: 09/291,440

(22) Filed: Apr. 13, 1999

(30) Foreign Application Priority Data

Apr. 14, 1998 (NL) ..... 1008874

(51) Int. Cl.[7] ..... G07F 1/04
(52) U.S. Cl. ..... 194/344; 221/251; 221/267
(58) Field of Search ..... 194/344; 453/50, 453/56, 57, 63; 221/251, 267, 308

(56) References Cited

U.S. PATENT DOCUMENTS 3,752,168 8/1973 Bayha .
3,904,077 * 9/1975 Luginbühl ..... 221/225 X
5,232,398 8/1993 Maki ..... 453/57
5,496,211 * 3/1996 Zimmermann ..... 453/56 X

FOREIGN PATENT DOCUMENTS 3830674 3/1990 (DE) .
0 469 886 2/1992 (EP) .
97/05581 2/1997 (WO) .

* cited by examiner

*Primary Examiner*—F. J. Bartuska
(74) *Attorney, Agent, or Firm*—Stroock & Stroock & Lavan LLP

(57) ABSTRACT

A coin elevating device for elevating a stream of coins from a coin collecting reservoir to a delivery location. The device includes a coin elevating channel which has an elongated base plate with two sidewall plates extending therefrom which are spaced apart a distance substantially corresponding to the diameter of a coin. Flexible bristle elements extend into the coin elevating channel so as to engage coins sliding therethrough and to maintain the coins in sliding contact with the base plate.

5 Claims, 2 Drawing Sheets

COIN ELEVATING DEVICE

BACKGROUND OF THE INVENTION

1. Field of the Invention

The present invention relates to a coin elevating device or so-called escalator adapted to transport coins in a serial and edge to edge mode from a coin collecting reservoir towards a dispensing location.

2. Description of the Prior Art

Such devices are known and are making part e.g. of coin dispensing devices, which are used e.g. in gambling machines and the like. With such devices the coin elevating device connects to the outlet opening of a coin collecting reservoir that is provided with a rotary disc, by means of which the coins are urged one by one through the outlet from the reservoir into a coin raising channel of the coin elevating device. Examples of such devices are disclosed in U.S. Pat. Nos. 4,437,478; 4,943,258 and 5,170,874 and in International patent application WO 97/05581.

With devices of this type it is important that the coins are pushed "edge to edge" through the elevating channel upwardly. The coins must be prevented from getting in overlapping positions like roof tiles and thereby getting jammed within the elevating channel. Taking measures to secure that the clearance within the elevating channel, as seen in the direction of the thickness of the coins, is a fraction of the coin thickness only, seems to be an obvious solution. For a number of reasons, however, this would not be an effective solution. Not counting the (slight) variations in thickness which may occur with one type of coin one may have to deal with coins that are bent or distorted otherwise and require a relative large clearance in the coin thickness direction.

Moreover the bottom of the collecting reservoir and the rotary disc are generally positioned at an angle relative to the vertical plane, so that the elevating channel is initially taking a position at the same angle, which position changes through a curve into a vertical (less space requiring) position, which curve also requires additional clearance in the coin thickness direction according to the curve being sharper and the coin diameter being larger.

For the above reasons relative large clearances are provided in the elevating channel with the well-known devices and the excess clearance is "taken away" through resilient means, that urge the coins onto the bottom or base plate of the elevating channel guiding base.

In the embodiment disclosed in U.S. Pat. No. 4,437,478 the resilient means are constituted by a spring blade that is positioned within the space between the two sidewall portions and extends through said space to engage the stream of coins within the raising channel. However, this has not proved to be a reliable means for preventing the coins from getting into mutually overlapping positions. Therefore in the embodiment disclosed in U.S. Pat. No. 5,170,874 the elevating channel is laterally confined—at least in the transitional area between an initial obliquely rising section and a vertical section of the elevating channel—by a series of conical rollers that are positioned side by side as seen in the conveying direction and are mounted to yield against spring action in the coin thickness direction. The combined resistive force exerted by these rollers on the stream of coins in the conveying direction, however, is considerable and means an increase of the energy which is required for driving the rotary disc. This applies in particular when the lateral edges in the flat sections of the elevating channel are confined by similar rollers so as to be able to deal with (strongly) bent coins.

The same disadvantage applies for the embodiment disclosed in International patent application WO 97/05581, wherein the resilient means are formed by a series of balls, which are spring loaded at right angles to the conveying direction and extend through a slot to engage the stream of coins (see the embodiment of FIG. 12 in particular).

Finally the embodiment according to U.S. Pat. No. 4,943,258 shows the use of a press ball, that extends through a longitudinal slot to engage a coin from the stream of coins. The ball is guided—from the side turned away from a base plate of the elevating channel—by a supporting surface that diverges relative to said base plate in the conveying direction. The ball may thus readily yield in the coin conveying direction. However, a returning movement of the respective coin and of all of the coins downstream of it, will be prevented under all circumstances, due to the ball tending, in such returning movement direction, to wedge the coin in place. In this way, in case of a stagnating supply of coins from the collecting reservoir, the ball—when provided at the right location—will prevent the stream of coins within the elevating channel from moving back towards the collecting reservoir. The construction just referred to, however, would not offer an effective solution for the above mentioned problems, which are connected with the existence of a sharp transitional curve in the elevating channel and/or the occurance of distorted (bent) coins. To solve such problems a series of balls would have to be used; in normal use, all of the balls would have to be simultaneously lifted from the respective seats and kept in the elevated positions, which would require a relatively large amount of additional driving energy.

The present invention aims at removing the drawbacks of the well-known devices by simple and effective means, which contribute to an undisturbed coin conveyance and requires less additional driving energy.

SUMMARY OF THE INVENTION

To accomplish the above object the present invention provides a coin elevating device, more particularly for elevating a stream of coins from a coin collecting location to a delivery location, comprising an elongated base plate with two sidewall plates extending therefrom and mutual spaced to substantially correspond with the diameter of a coin, said sidewall plates forming together with said base plate a coin elevating channel, resilient means being provided to keep the coins moving through the channel pressed onto the base plate, wherein the yielding press means are formed by a package of flexible bristle elements which extend from a corer plate, the free ends of said flexible bristle elements extending through the space between the two sidewall plates into the elevating channel.

In each point of the trajectory covered by the package of flexible bristle elements the coins are engaged by the free ends of the bristle elements and thereby smoothly pressed onto the base plate. Differences in space between the coin engagement point and the base plate, which are the result of differences in coin thickness, the occurance of distorted coins or the presence of a relatively sharp transitional curve in the elevating channel, are smoothly compensated due to the fact that the free ends of the flexible elements will bent either more or less according to said difference in space being larger or smaller. In fact the device of the present invention is suitable for treating coin types of different thicknesses. The combined resistance of the flexible elements against coin conveyance in the upward direction will be kept low.

In a preferred embodiment the flexible elements are positioned to direct obliquely in the conveyance direction. Such a position has the advantage that the resistance to coin movement in the upward direction is very low, whereas the resistance to movement in the opposite (returning) direction is relatively high, because in that direction the elements will act as a sort of bearded arrow; this prevents undesired return movements, e.g. in case of a stagnating coin supply from the coin collecting location.

It is to be noted that document U.S. Pat. No. 3,752,168 discloses a coin handling device, in which coins from a coin collecting reservoir are dropped on a series of rams, which take slightly upwardly inclined positions as seen in the desired conveying direction towards a dispensing chute. To cause the coins to move in the desired direction, the rams are vibrated and covered with a mohair fabric, the piles of which are obliquely directed in the conveying direction. Thus the coins are floating on the mohair piles rather than being urged by such piles in contact with a base plate as is the case with the present invention.

With the well-known means it would not be possible to have a series of coins move in edge to edge contact along a base plate that extends almost vertically upwardly from a coin reservoir. Obviously the well-known device according to U.S. Pat. No. 3,752,168 is not of the escalator type.

According to a further feature of the invention the bristle elements take mutually overlapping positions, like roof tiles.

In a practical embodiment the flexible bristle elements are packed together to form of a brush.

A particular embodiment of the device of the present invention is characterized in that the flexible bristle elements or are planted in a the cover plate, which is supported by the sidewall plates.

A simple construction allowing easy assembling may be obtained in accordance with a further feature of the invention, which is characterized in that the cover plate is flexible in the longitudinal direction and has its longitudinal edges slidably engaged in grooves provided in the opposite faces of the sidewall plates. Due to its longitudinal flexibility the cover plate may smoothly adapt itself to curves occurring in the elevating channel.

BRIEF DESCRIPTION OF THE DRAWINGS

The invention will hereinafter be further explained by way of example with reference to the drawing.

DETAILED DESCRIPTION OF A PREFERRED EMBODIMENT

Figure 1:
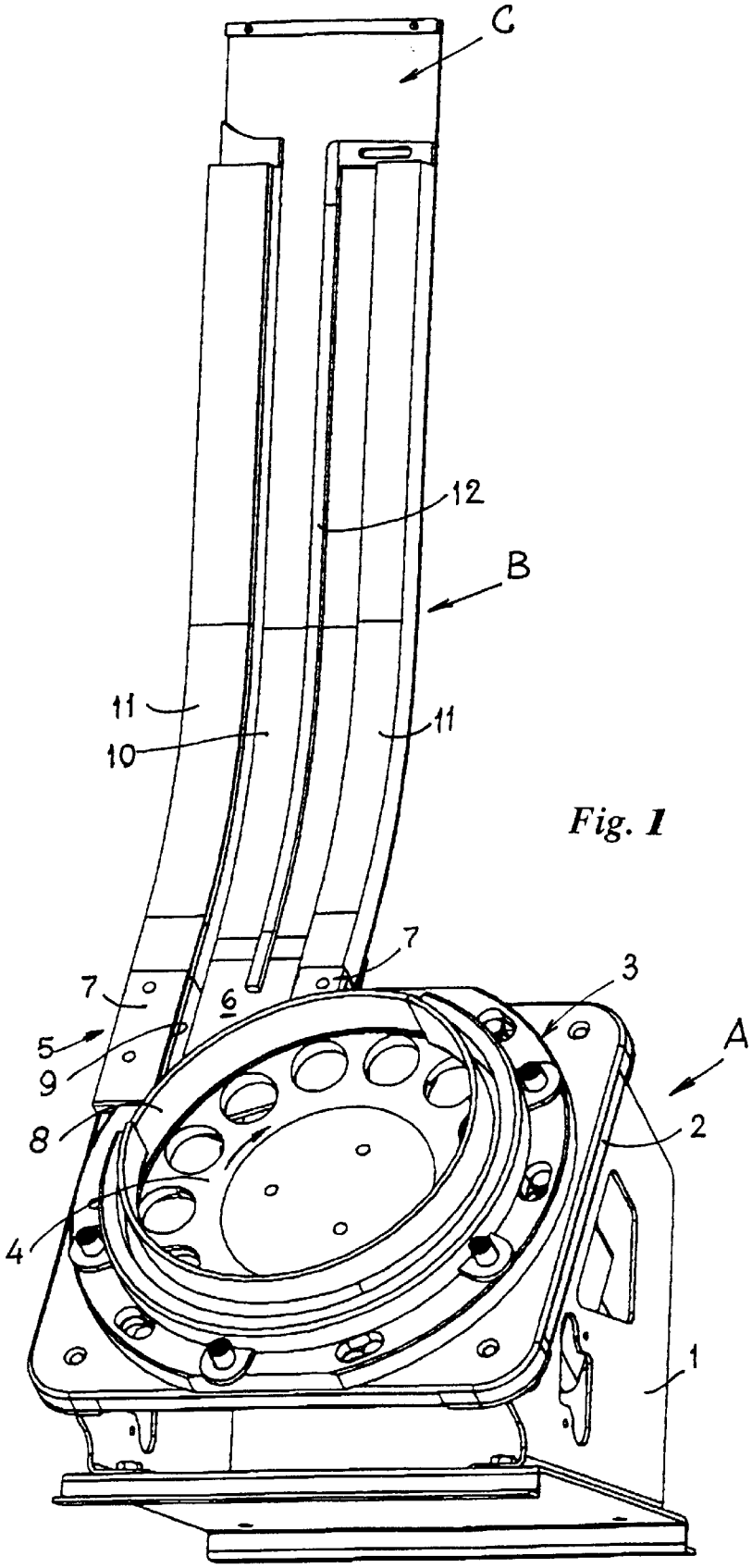
FIG. 1 shows a front perspective view of a coin collecting and dispensing device, provided with the coin elevating device according to the present invention.

Part A of the device shown in FIG. 1 is of a well-known type. It comprises a housing 1 with a sloping wall 2, on which the bottom 3 of a coin collecting reservoir (not further shown) is mounted.

On top of a fixed bottom plate (not shown) a disc 4 provided with coin receiving openings is mounted to be driven in the arrow direction by means of a drive mechanism provided within the housing 1.

In use, while the disc 4 is rotating, coins passing and dropping through the openings of the disc onto the fixed bottom plate are engaged by projections (not shown) provided on the lower face of the disc 4 and taken along in the direction of rotation of the disc. The coins move along a guiding edge extending from the bottom plate, which edge guides the coins towards a coin outlet 5 that is directed tangentially outwardly and obliquely upwardly. Adjacent the coin outlet 5 abutment and guide means are provided on the bottom plate below the disc 4 which cause the coins to move one by one through the outlet 5 outwardly. Moreover the passing coins are counted.

The coin outlet 5 is confined by a base plate portion 6 in the plane of the fixed bottom plate and two upstanding sidewall portions 7. The sidewall portions 7 connect to a circumferential wall portion 8 that delimits a coin collecting space above the disc 4. The spacing between the sidewall portions 7 is adapted to the largest occurring coin diameter (N.B. Each time the right disc will have to be mounted, i.e. a disc provided with passage openings of a diameter that is adapted to the coins to be handled.

So far the device is, in fact, of a well-known construction.

B designates the coin elevating device of the present invention which connects to the coin outlet 5. This elevating device comprises an elongated base plate or base 10 and two upstanding sidewall plates 11 extending at the longitudinal edges of said base plate. An elevating channel in register with the coin outlet 5 is obtained herewith. Said channel extends initially at the same elevational angle as the coin outlet 5, but changes through a curve into a more vertical position, as is clearly shown in FIG. 1. For adjustment to coin diameters which are smaller than the largest diameter, a transversally adjustable guiding rib 12 is provided on the base plate base 10. Thus the elevating channel is confined between the left sidewall plate 11 and the rib 12.

In use the rotating disc 4 and the coins provided on the lower surface thereof are urged "edge to edge" through the coin outlet 5 and elevating the connecting elevating channel upwardly, towards the delivery location C.

Figure 2:
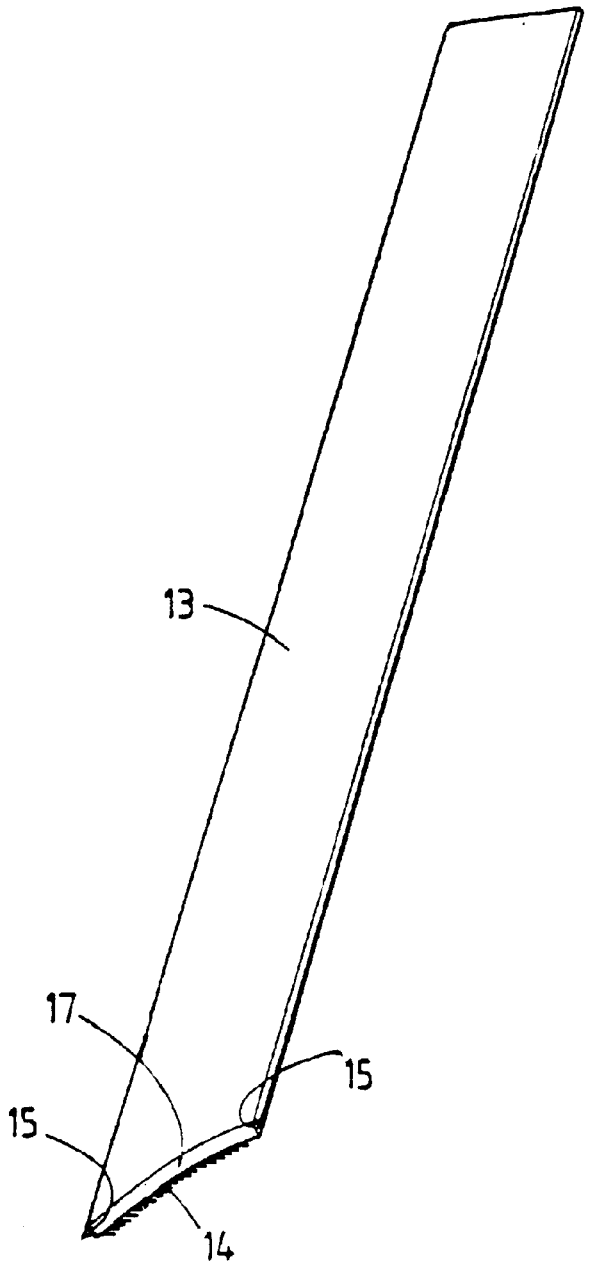
FIG. 2 shows the cover plate with the brush bristles extending therefrom, by means of which the elevating channel of the coin guiding device of FIG. 1 may be closed on the front/upper side

To make sure that the edge contact between the coins moving upwardly through the elevating channel is also taking place in the curve of the elevating channel and is kept under all circumstances the raising channel is covered at its front side by the element shown in FIG. 2 which is in the form of an elongated cover plate 13, one side of which is provided with brush bristles 14 implanted therein.

The longitudinal edges 15 of the cover plate 13 are formed to slidingly fit in corresponding longitudinal grooves 16 in the opposite faces of the upstanding sidewall plates 11 of the elevating channel and in the grooves 9 in the sidewall portions 7 of the coin outlet 5 positioned in register therewith. The cover plate 13 can be simply inserted into the grooves 16 from above, at C.

The cover plate, which is flat in untensioned position, has the necessary flexibility that allows the cover plate 13, while it is being inserted, to adapt itself to the curve in the elevating channel. The lower terminal end of the cover plate 13 is formed by a terminal edge that takes an oblique position relative to the longitudinal axis and is adapted to the circumferential wall portion 8.

Figure 3:
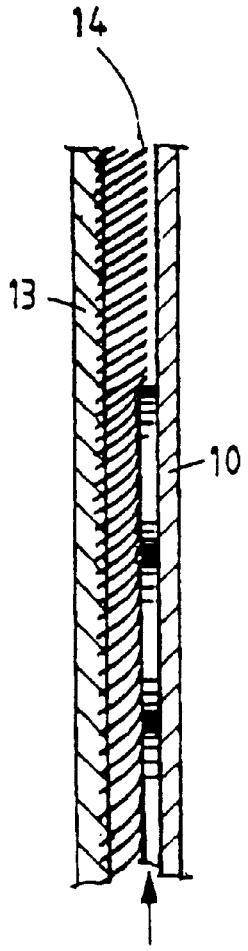
FIG. 3 shows a cross-sectional view through a section of the elevating channel of the coin elevating device.

In the cross-sectional view of FIG. 3 it is shown that the brush bristles 14 are directed obliquely in the upward conveying direction and that the yielding brush bristles urge the coins onto the base plate 10. It will be understood that the pressure exerted by the bristles will be larger or smaller according to the stiffness of the selected brush bristles being larger or smaller. Implanting the brush bristles in an oblique position as seen in the conveying direction has the advantage that the resistance to displacement in the conveying direction will be relatively low, whereas the bristles will have a blocking effect in the opposite direction. FIG. 3 also shows that in the inoperative state of the bristles there is a slight space between the bristles and the base plate, which is smaller than the smallest coin thickness.

It will be clear that the coin elevating device B of the invention may also be applied with any type of coin collecting device, that is provided with a coin outlet similar to the device A described hereinabove.

What is claimed is:

1. A coin elevating device for elevating coins from a coin collecting reservoir to a delivery location, wherein coins arc conveyed serially in a coin conveying direction and in edge-to-edge contact from the reservoir through an outlet into and through a coin elevating channel that extends from said outlet upwardly towards said delivery location, said coin elevating channel comprising an elongated upwardly extending base plate and a pair of sidewall plates which are spaced by a distance corresponding to the diameter of a coin;

an elongated cover plate disposed opposite to said base plate and carrying resilient press means which extend into the space between said sidewall plates to engage coins within said coin elevating channel so as to keep the coins in resilient sliding contact with said base plate, wherein said resilient press means is formed by flexible bristle elements which are packed together to form a brush-like package, the individual bristle elements project into the coin elevating channel in direct contact with the coins contained therein and with the free ends of the bristle elements flexing in the coin conveying direction.

2. A device according to claim 1, wherein the bristle elements are obliquely directed relative to the coin conveying direction.

3. A device according to claim 1, wherein the bristle elements are implanted in said elongated cover plate, which is supported by the sidewall plates.

4. A device according to claim 3, wherein said elongated cover plate is slidingly receivable with its longitudinal edges in corresponding grooves in the opposed faces of said sidewall plates.

5. A device according to claim 4, wherein at least one curve connects portions of said coin elevating channel having different angles of inclination, and wherein said elongated cover plate is a flexible plate that is capable of flexing from a flat tension-free state according to the shape of said at least one curve when sliding said plate through said grooves into position.

* * * * *